US005217160A

United States Patent [19]

Lopes

[11] Patent Number: 5,217,160

[45] Date of Patent: Jun. 8, 1993

[54] PNEUMATIC SPRAYING APPARATUS AND METHOD

[76] Inventor: Gregory A. Lopes, 214 Abele St., Woodland, Calif. 95695

[21] Appl. No.: 907,605

[22] Filed: Jul. 2, 1992

[51] Int. Cl.[5] ..... B05B 9/04; B05B 7/00

[52] U.S. Cl. ..... 239/8; 239/61; 239/332; 418/266

[58] Field of Search ..... 239/8, 61, 332, 340; 222/145, 334, 617, 626, 630, 637; 418/266

[56] References Cited

U.S. PATENT DOCUMENTS

| | | | |
|---|---|---|---|
| 2,558,681 | 6/1951 | Hachmeister | 299/96 |
| 3,018,968 | 1/1962 | Levey | 239/124 |
| 3,322,351 | 5/1967 | Hackel | 239/332 |
| 4,789,145 | 12/1988 | Wenrich | 267/160 |
| 4,822,644 | 4/1989 | Krueger | 427/280 |
| 4,878,619 | 11/1989 | Norman | 239/318 |
| 4,878,621 | 11/1989 | Krueger | 239/458 |

OTHER PUBLICATIONS

Goldblatt 1990 Catalog pp. 54–55.

*Primary Examiner*—Andres Kashnikow
*Assistant Examiner*—Lesley D. Morris
*Attorney, Agent, or Firm*—Flehr, Hohbach, Test, Albritton & Herbert

[57] ABSTRACT

A pneumatic spraying apparatus and method of operation is disclosed for controlling the flow of pressurized air and fluid material through a spray gun. A material pump is driven through a ratio multiplier by an air motor which is operated by a source of pressurized air. A discharge port in the air motor is connected by an air hose to the gun through a control valve leading to a chamber from which the material is sprayed by air pressure downstream of the valve. Selective operation of the valve controls the downstream air pressure and air flow rate through the gun which in turn modulates air motor speed and torque by controlling the rate of air flow and pressure from the discharge port. This in turn controls the pump speed through the action of the ratio multiplier.

6 Claims, 1 Drawing Sheet

PNEUMATIC SPRAYING APPARATUS AND METHOD

BACKGROUND OF THE INVENTION

This invention relates in general to fluid spray systems, and more particularly relates to a pneumatic spraying apparatus and method for use with a variety of viscous and semi-viscous materials such as paint, plaster, acoustic dry wall material, waterproofing, fireproofing and mortar for stucco application.

Pneumatic spraying apparatus, commonly known as spray rigs, have been provided for spraying work. Typically, the prior spray rigs comprise a mobile frame which carries an electric motor or gasoline engine, air compressor, fluid pump, material hopper, belts, pulleys, transmission and electric clutches for driving the compressor and pump, and a spray gun connected by hoses to the compressor and pump. The spray rigs are operated by a system which includes an electrical control for engaging and disengaging the clutches for the pump, a material shut-off valve, an adjustable air valve, and an adjustable valve in the gun for controlling spray pattern density. Certain of the units also include controls for varying the speed of the transmission which is coupled with the electric motor or gas engine.

The prior art spray rigs of the type described with the relatively complicated belts, clutches and associated transmission equipment produce a costly arrangement which is relatively difficult to maintain and repair. The prior spray rigs are also cumbersome in operation as a result of the relatively complicated system for separately controlling the pumping action and valves in the spray gun.

OBJECTS AND SUMMARY OF THE INVENTION

It is accordingly a general object of the present invention to provide a new and improved pneumatic spraying apparatus and method of operation which obviates many of the disadvantages and limitations of existing spray rigs.

Another object is to provide spraying apparatus and method of the type described which is relatively more simple in construction and number of components with reduced maintenance and repair requirements.

Another object is to provide spraying apparatus and method of the type described having a simplified arrangement for controlling material and air flow to the spray gun.

Another object is to provide spraying apparatus and method of the type described having a simplified control arrangement in which the material pumping action is responsive to the control of air flow in the spray gun.

The invention in summary provides a pneumatic spraying apparatus, and method of operation, incorporating a spray gun with an air control valve for controlling the flow of pressurized air through the gun for discharge in a spray pattern. The material is supplied to the gun by a pump which is driven through a torque multiplier by an air motor. Pressurized air from a compressor is directed through an inlet port of the motor and, when the discharge flow path is open, the motor applies an output torque to a drive shaft which inputs into the torque multiplier. An air conduit is connected between the discharge port of the motor and an air channel leading to the air valve of the gun. Operation of the air control valve controls air flow through the discharge port of the motor which in turn controls operation of the material pump.

The foregoing and additional objects and features of the invention will appear from the following specification in which the several embodiments have been set forth in detail in conjunction with the accompanying drawings.

DESCRIPTION OF THE PREFERRED EMBODIMENTS

Figure 1:
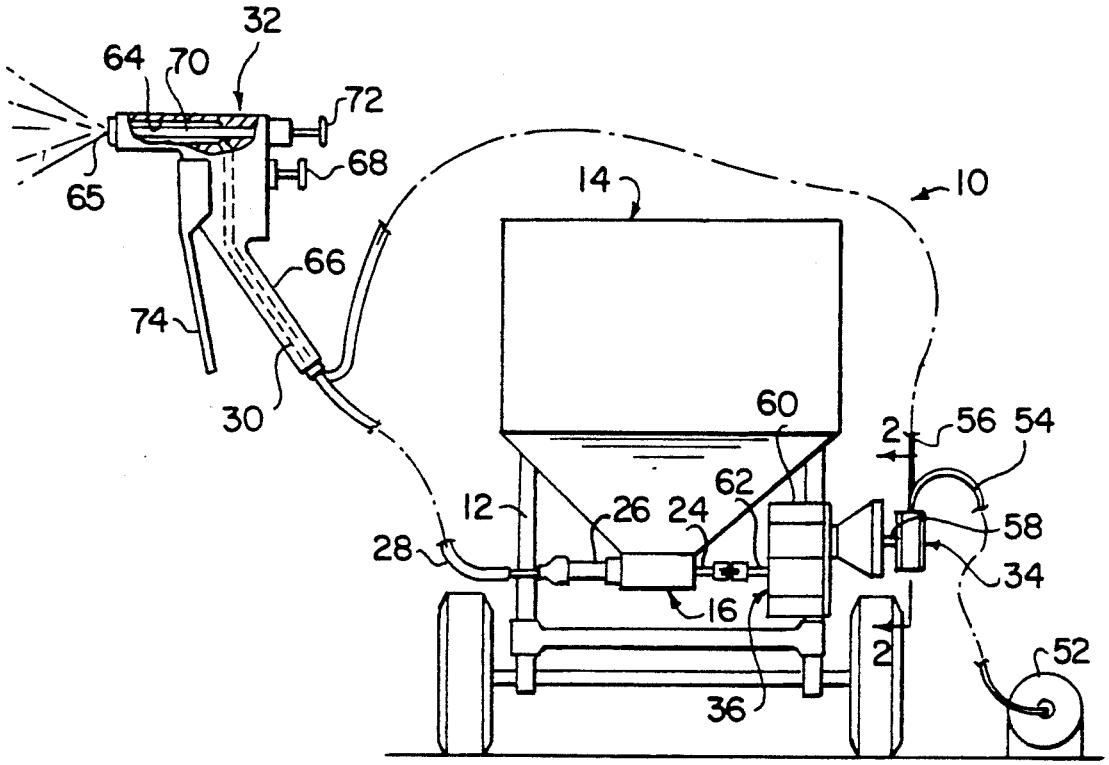
FIG. 1 is an elevational view illustrating a pneumatic spraying apparatus which carries out the method of operation of a preferred embodiment of the invention.

In the drawings FIG. 1 illustrates generally at 10 a pneumatic spraying apparatus incorporating a preferred embodiment of the invention. Apparatus 10 provides a spray rig which is comprised of a mobile frame 12 mounting an open-ended hopper 14 in which a supply of the desired fluid spray material is contained. The invention is adapted for spraying a wide variety of viscous and semi-viscous fluid materials including paint, plaster, acoustic dry wall, wall/ceiling texturing, waterproofing, fireproofing and motor for stucco application.

Figure 3:
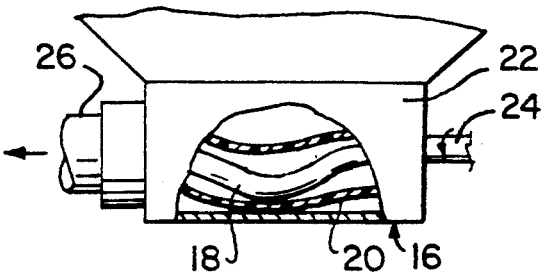
FIG. 3 is an enlarged detail view, partially broken away, of the stator tube pump which is a component of the apparatus of FIG. 1.

A pump 16 is mounted on the frame below an opening in the lower end of the hopper. Preferably the pump is of the axial flow type known as a stator tube pump having a helical rotor 18 (FIG. 3) which turns within a rubber tube 20 mounted in the pump housing 22. The rotor is driven by an input shaft 24. Alternatively, the pump could be of the worm drive type. Outlet end 26 of the pump is coupled to a flexible hose 28 which leads to the material flow channel 30 in a spray gun 32. Pump 16 is operated by a drive arrangement which includes an air motor 34 coupled through a ratio multiplier 36 to pump input shaft 24.

Figure 2:
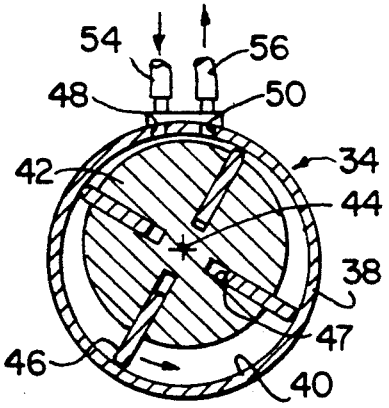
FIG. 2 is a cross-sectional view to an enlarged scale of the air motor taken along the line 2—2 of FIG. 1.

Air motor 34, best shown in FIG. 2, preferably is of the sliding vane type and comprises a housing 38 formed internally with a cylindrical chamber 40. A rotor 42 is mounted within the chamber for rotation about an axis 44 which is positioned eccentric of the chamber. A plurality of radially extending vanes 46, shown as four, are mounted to slide within respective slots 47 formed at equal circumferentially spacing about the rotor. An air inlet port 48 and discharge port 50 are formed in the upper end of the housing straddling the point of tangency of the rotor with chamber 40.

A source of pressurized air, such as an air compressor 52, is connected through an air hose 54 to motor inlet port 48, and an air hose 56 couples discharge port 50 with spray gun 32. When the flow path through discharge port 50 and air hose 56 is open, the pressurized air is free to flow through the motor to act against the vanes and turn the rotor, with spent gas exiting through the discharge port. The illustrated embodiment shows the air compressor as a separate unit apart from mobile frame 12 to provide a more portable rig, although provision could be made for mounting the compressor directly on the frame.

When air motor 34 is in operation its rotor turns an output drive shaft 58 which is coupled to the input of torque multiplier 36. The torque multiplier is comprised of a housing 60 which contains a suitable step-down gear train, not shown, having an output drive shaft 62 coupled to the pump input shaft 24. The air motor inherently has a relatively high rpm and low torque output. The gear train of multiplier 36 increases the drive torque, and reduces the rpm, into pump 16. The ratio of torque multiplication depends upon the particular gear train arrangement, and is set in accordance with the requirements of a particular application. For example, seperate gear sets can be installed in multiplier 36 to set the multiplication ratio as low as 2x for pumping light weight materials or up to 5x or more for heavier materials. The higher multiplier ratios would be suitable for use with a faster air motor speed with a higher air pressure drop across the motor.

Spray gun 32 utilizes the air discharging from air motor 34 both as the supply of air for spraying material and for controlling material flow by controlling the operation of the air motor and pump. The spray gun housing has a barrel chamber 64 which is formed at the front end with a spray nozzle 65 having an orifice. Air hose 56 is connected through a coupling with an air channel 66 in the handle of the gun. The air channel leads through a pressure control valve 68 and thence into an air tube 70 mounted coaxial within the barrel chamber. Control valve 68 includes a manual adjustment knob for controlling downstream pressure into the air tube. A spray control knob 72 is provided for selectively adjusting the axial position of air tube 70 for controlling the spray pattern.

In the gun material flow channel 30 leads into the annulus of barrel chamber 64 surrounding the air tube. Material in chamber 64 is entrained with pressurized air jetting from the end of the air tube outwardly through the orifice in a spray pattern. Material flow into the barrel chamber is controlled by a spindle valve, not shown, which is moved axially between its fully closed and fully opened positions by a hand-operated trigger 74. As desired, pressure control valve 68 can include an air valve, not shown, which is bistably operated between on and off positions under influence of the trigger in accordance with the disclosure of co-pending application Ser. No. 644,931 filed Jan. 23, 1991, now U.S. Pat. No. 5,156,340, by the present inventor. As disclosed in that co-pending application, with the trigger in its off position the bistable air valve shuts off the air flow through the gun, and with the trigger in any one of its stepless operating positions, the bistable valve fully opens the air flow to control valve 68.

When gun trigger 74 is in one of its operating positions, selective manual adjustment of control valve 68 varies the downstream pressure which in turn varies the rate of air flow through channel 66, air tube 70 and out through the spray orifice. As is well known, the amount of material breakup and dispersion in the spray pattern is a function of the air flow volume, with a greater volume breaking up and dispersing material to a greater extent. The selective adjustment of control valve 68 also modulates the speed of air motor 34 which in turn modulates the pump speed to control the material pumping rate. A reduction in air flow through the gun and hose 56 throttles the air through discharge port 50 to proportionally reduce the air motor speed which correspondingly reduces pump speed.

The method of operation of pneumatic spraying apparatus 10 will be explained in relation to a typical portable spray rig configuration in which the hopper 14 is of 20-gallon capacity. Air compressor 52 is rated at 3 horsepower providing 9.5 cfm displacement and 5.5 cfm air delivery at 100 psi maximum pressure. Ratio multiplier 36 has a gear train producing a 3:1 step down speed ratio. With spray gun control valve 68 turned open, spraying is initiated when the operator pivots trigger 74 inwardly toward the handle to a selected operating position. The spindle valve in the gun responds to open the material flow channel through the gun while the bistable valve simultaneously is moved to its open position. This permits air to flow through the spray gun from hose 56, permitting air to discharge from port 50 of the air motor. The air pressure delivered through inlet port 48 acts against the vanes 46 to turn rotor 42. Assuming that the inlet pressure is 90 psi when the motor is operating, the pressure drop across the motor is approximately 5 psi resulting in an 85 psi outlet pressure. This 85 psi air is delivered to gun 32 for spraying the material. Air motor drive shaft 58 applies an output torque into ratio multiplier 36 which reduces the drive speed by $\frac{1}{3}$ and multiplies the torque by 3x into input shaft 24 of pump 16. Pump rotor 18 turns within tube 20 and pumps the material feeding down from the hopper through hose 28 into the spray gun.

As the gun trigger is held open to one of its operating positions, the operator can manually adjust control valve 68 for selectively varying the air flow rate through the gun from hose 56. This flow adjustment also modulates the air motor speed and torque. Thus, when the control valve is progressively turned open to decrease downstream pressure and increase air flow rate through the gun, the air motor speed is increased due to the increase in pressure drop between the inlet and discharge ports. This in turn increases pumping speed and material flow rate into the gun so that a greater volume of material is sprayed. As the control valve is progressively turned back, the air flow rate and pump speed are correspondingly reduced. With the trigger in its fully closed position the bistable valve is closed and the air motor is shut off because air cannot discharge through port 50. Pump 16 is thereby turned off to shut down material flow into the spray gun.

It is apparent that the invention provides a relatively simple and elegant spray rig assembly involving fewer components than most conventional spray rigs, and which is easier to use and operate. The invention eliminates the need for the electric clutches, switches, belts, pulleys and transmission usually required in conventional spray rigs, and provides a simplified arrangement for simultaneously controlling pumping operation through control of the air spray flow.

While the foregoing embodiments are at present considered to be preferred it is understood that numerous variation and modifications may be made therein by those skilled in the art and it is intended to cover in the appended claims all such variations and modifications as fall within the true spirit and scope of the invention.

What is claimed is:

1. Pneumatic spraying apparatus comprising the combination of a spray gun having chamber means for containing a mixture of pressurized air and fluid material, nozzle means opening from the chamber for discharging the mixture outwardly in a spray from the chamber, air channel means for directing pressurized air into the chamber, and means for controlling a flow of pressurized air through the air channel means into the chamber means for mixing with the fluid material therein, said apparatus further comprising pump means for pumping a supply of the material along a flow path to said chamber; an air motor having an inlet port connectable to a source of pressurized air, a discharge port, and an output drive shaft which produces an output torque responsive to a flow of pressurized air into the inlet port and out the discharge port; torque multiplier means for driving said pump means with a drive torque which is a predetermined multiple of said air motor output torque, said pump means pumping the material along said path at a flow rate substantially proportional to said drive torque; and an air conduit connected between the discharge port of the air motor and the air channel in the gun, said air motor output torque being responsive to the rate of air flow through the discharge port and thereby responsive to said air flow through the channel in the gun.

2. Pneumatic spraying apparatus as in claim 1 in which said torque multiplier means produces said drive torque at a magnitude in the range of from three to five times said air motor output torque.

3. Pneumatic spraying apparatus for spraying a fluid material with pressurized air comprising the combination of a spray gun having a chamber with an orifice for discharging a spray of pressurized air and fluid material; a material flow channel in the gun connected with the chamber; an air channel in the gun leading to said orifice for entraining therewith material from said flow channel; control means for controlling the flow of air through the air channel; pump means for pumping material into the material flow channel of the gun; a compressed air-driven motor having an output drive shaft; means for directing compressed air into the motor for turning the output drive shaft; a discharge port in the motor for discharging spent air whereby operation of the motor applies an output torque to the drive shaft of the motor; torque multiplier means connected with the output shaft of the motor and for applying a drive torque to the pump which is a predetermined multiple of said output torque; means for connecting the discharge port of the motor with the air channel of the gun, and said control means comprises means for opening the air channel in a first mode for spraying and for closing the air channel in a second mode for shutting the spray off whereby operation of the said control means to its second mode shuts off the flow of air from the discharge port so that the motor no longer produces output torque and the pump is thereby shut down.

4. Pneumatic spraying apparatus as in claim 3 in which said control means includes valve means for selectively varying the air pressure in said air channel whereby the volume of air sprayed from the orifice is varied while simultaneously the motor output torque is correspondingly varied for varying the flow rate of material from the pump to the gun.

5. A method for spraying fluid material from a source of pressurized air with a spray gun having a chamber with an orifice through which the air and material are discharged in a spray pattern, the method comprising the steps of providing an air motor having an inlet port, a discharge port and a rotor having an output shaft; directing pressurized air through the inlet port for rotating the rotor and output shaft while directing exhaust air through the discharge port along a control path leading to the orifice of the gun; providing a pump having a rotatable pumping element which pumps a supply of the fluid material along a flow path into the chamber for entrainment with said air from the control path; multiplying the torque of the motor output shaft to a driving torque; applying the driving torque to rotate the pumping element; controlling the flow of pressurized air through said control path to a selected flow rate; controlling the flow of air through the discharge port of the motor responsive to the flow rate of air through the control path; and controlling the torque of the air motor output shaft responsive to the flow of air through the discharge port for controlling the driving torque on the pumping element and thereby controlling the rate at which material is pumped into said chamber of the gun.

6. A method as in claim 5 in which the flow of air through the gun is controlled between on and off conditions whereby the flow of material into the chamber is respectively turned on and shut off.

* * * * *